US005232608A

United States Patent [19]

Mayer

[11] Patent Number: 5,232,608

[45] Date of Patent: Aug. 3, 1993

[54] TEMPLATE FOR FORMING GLASS BLOCK PANEL MODULES

[76] Inventor: Emil Mayer, 30 Timber La., Manhasset, N.Y. 11030

[21] Appl. No.: 973,596

[22] Filed: Nov. 9, 1992

Related U.S. Application Data

[63] Continuation of Ser. No. 653,384, Feb. 8, 1991, abandoned.

[51] Int. Cl.[5] ..... B28B 7/00

[52] U.S. Cl. ..... 249/96; 249/83; 249/140; 249/156; 264/261; 425/123

[58] Field of Search ..... 249/1, 15, 16, 31, 32, 249/60, 83, 96, 119, 120, 127, 132, 140, 142, 156, 157, 160, 189; 264/261; 425/123

[56] References Cited

U.S. PATENT DOCUMENTS

| | | | |
|---|---|---|---|
| 986,767 | 3/1911 | Seipp | 249/2 |
| 997,533 | 7/1911 | Zacharias | 249/2 |
| 1,211,133 | 1/1917 | Geiger et al. | 249/91 |
| 1,836,964 | 12/1931 | Grigsby et al. | 52/387 |
| 1,874,790 | 8/1932 | Mortenson | 52/387 |
| 2,426,796 | 9/1947 | Stadelhofer | 249/91 |
| 2,852,932 | 9/1958 | Cable | 52/385 |
| 3,192,567 | 7/1965 | Abernethy et al. | 425/123 |
| 3,317,178 | 5/1967 | Kreier, Jr. | 249/115 |
| 3,479,786 | 11/1969 | Kreier, Jr. | 249/127 |
| 3,602,476 | 8/1971 | Iragorri | 249/96 |
| 3,770,863 | 11/1973 | Elgenstierna | 264/261 |
| 4,118,261 | 10/1978 | Pedler | 264/261 |
| 4,774,793 | 10/1988 | Mayer | 52/308 |
| 4,832,309 | 5/1989 | Derby-Lewis | 249/176 |
| 4,959,937 | 10/1990 | Mayer | 52/308 |
| 5,009,387 | 4/1991 | Scott et al. | 249/96 |

FOREIGN PATENT DOCUMENTS

| | | | |
|---|---|---|---|
| 127360 | 2/1948 | Australia | 249/32 |
| 557223 | 7/1932 | Fed. Rep. of Germany | 249/60 |
| 473458 | 7/1953 | Italy | 249/32 |
| 1147104 | 4/1969 | United Kingdom . | |

*Primary Examiner*—Jay H. Woo
*Assistant Examiner*—James P. Mackey
*Attorney, Agent, or Firm*—Pennie & Edmonds

[57] ABSTRACT

Architectural glass block walls or panels are constructed by assembling glass block panel modules which are pre-formed by using molding templates. The template has a plurality of sets of crisscrossing upstanding ribs and a plurality of square pockets surrounded by the ribs. Glass blocks are placed in the pockets and mortar is injected into the spaces between adjacent blocks.

2 Claims, 1 Drawing Sheet

TEMPLATE FOR FORMING GLASS BLOCK PANEL MODULES

Figure 1:
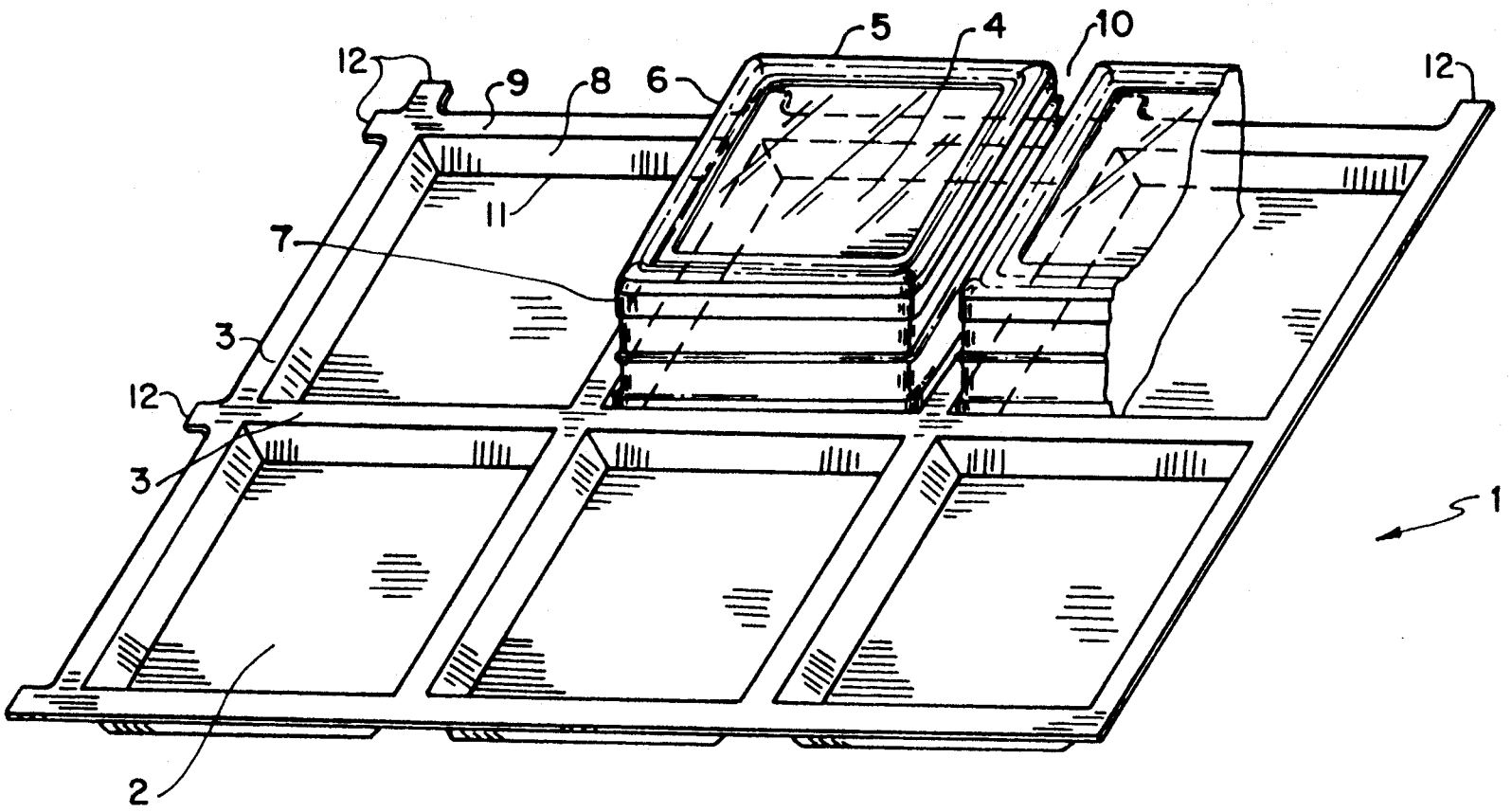

This is a continuation of application Ser. No. 07/653,384, filed Feb. 8, 1991, now abandoned.

1. BACKGROUND OF THE INVENTION

1.1. Technical Field

This invention relates to walls or panels made of glass blocks and to templates and methods for using such templates in constructing such walls and panels. More particularly, the invention relates to templates to form glass block panel modules which can be subsequently assembled into glass block walls and panels.

1.2. Background Art

Glass blocks are architecturally favored as a unique construction material from the standpoint of their usefulness in forming walls and panels having an aesthetically pleasing appearance, thermal and sound insulating ability, weather resistance coupled with low maintenance requirements, resistance to vandalism and forced entry, and ability to transmit light to virtually any desired degree to provide optimum illumination.

Most commonly used glass blocks are formed by fusing together two pressed halves of glass which results in an upstanding central projection or ridge around the middle of the circumference of the block. Conventionally, glass block panels and walls are usually built or assembled on-site using mortar, cement, grout, or caulking material (hereinafter referred to collectively as "mortar") as is the practice with regular bricks or cement blocks. Such walls and panels can be also be preassembled elsewhere and shipped to the job site.

The non-porous, non-absorbent surfaces of glass blocks do not permit the formation of a strong bond between block and mortar, and several schemes have been devised to overcome this drawback. For example, the circumferential surfaces of some glass blocks are roughened by the manufacturer; also, resinous coatings have been applied to such surfaces so that the mortar can better adhere to them.

In laying glass blocks to form a wall or panel, greater care is needed than with other types of masonry, e.g., bricks, and cement or cinder blocks. Glass blocks are usually laid up in straight, horizontal courses and vertical tiers rather than overlapping as in the case of bricks and cinder or cement blocks, and it is important architecturally, aesthetically and structually, that the blocks be uniformly spaced, both horizontally and vertically. Moreover, since mortars that are suitable for use in laying glass blocks are generally of the slow setting type, only a few courses of blocks can be laid up at a time; otherwise, the weight of freshly laid blocks will tend to squeeze out the mortar between the lower courses of blocks, making it difficult to align the blocks properly. Special fast-setting mortars are sometimes used in order to try to avoid this problem, but this entails undesirable trade-offs from a structural standpoint. Consequently, the building of glass block walls and panels can be a time-consuming (and hence labor-intensive) task which requires a high level of skill. The use of spacers for glass blocks, as described, for example, in the present inventor's U.S. Pat. Nos. 4,774,793 and 4,959,937, whose disclosures are incorporated herein by reference, enhances the quality while reducing the cost of glass block wall and panel construction. This method depends, however, upon the quality of the glass blocks used and, to some extent, the skill of the mason or laborer.

Glass blocks are manufactured to certain dimensional tolerances which allow for deviations from the exact dimensions specified for the block. These deviations can be dealt with easily in the prefabrication system of the invention described herein, because they are accommodated in the width of the mortar-cement joint between the blocks, whereby the peripheral dimensions of the glass block module can be achieved with a high degree of accuracy and precision. Thus, the overall dimensions of a glass block panel or wall (comprising a multiplicity of precisely dimensioned prefabricated glass block modules) specified by the architect can be achieved notwithstanding the dimensional deviations among the individual blocks.

Prefabricated units or modules of multiple glass blocks having cured mortar-cement joints are easy and quick to install, and consequently walls and panels of multiple prefabricated modules can be erected easily. The freshly mixed mortar-cement joint will set as if cementing bricks or concrete blocks, because the water can be absorbed into the existing dried mortar-cement joints at the periphery of each prefabricated module.

For all of these reasons, glass block walls and panels, despite their architectual advantages, are often eschewed by builders and others who must pay the relatively high labor cost in constructing them.

In the field of materials suitable for building construction other than glass blocks, such as ceramic tiles, bricks, stones, marbles and granites, a number of efforts have been made over the years to facilitate the construction of panels by using molds, templates or the like.

U.S. Pat. No. 1,836,964 discloses a tiled wall comprising a foundation sheet and rigid tiles. The sheet has a plurality of sets of parallel projections or ribs which form pockets on its face. In the step of mounting the tiles on the foundation sheet, the base portion of the tile is coated with cement and placed in the pockets. A groove between adjacent tiles is filled with cement.

U.S. Pat. No. 1,874,790 discloses a sheet of metal which has a retaining means for building materials. The sheet has rectangular openings and flanges to receive and retain a plurality of blocks or tiles.

U.S. Pat. No. 3,192,567 discloses a mold assembly for forming pre-grouted ceramic tile sheets. The mold assembly comprises upper and lower mating mold sections which are formed of a plurality of criss-crossing ribs separated by open wells. It also comprises a means for injecting fluid grout material into the clamped mold sections to fill the spaces between adjacent tiles.

However, in the particular field of glass block panel and wall construction, no such techniques or methods are known. A need therefore exists for an innovative means and method to facilitate the laying of glass blocks, and for glass block walls and panels formed by using such means.

Accordingly, it is an object of the present invention to provide a means for forming glass block panel modules for use in building glass block panels and walls.

Another object is to provide a fast, easy and economical method of making pre-assembled glass block panel modules which can be advantageously used in the construction of glass block walls and panels.

These and other objects of the invention as well as the advantages thereof can be had by reference to the following description, drawing and claims.

2. SUMMARY OF THE INVENTION

The foregoing objects are achieved according to the present invention, one aspect of which is a template for forming glass block panel modules. Such modules can be made on-site or can be conveniently fabricated elsewhere (e.g., in a factory) and shipped to the job site to be assembled into glass block walls and panels.

The template is desirably of an integral, unitary stamped or molded construction and is configured to have a plurality of criss-crossing, upstanding (upwardly projecting) ribs or ridges, and a plurality of square pockets encompassed and defined by the ribs. The number of pockets is determined by the number of glass blocks intended to constitute each module. Each pocket is configured so that it can be mated with or fitted to one side of the correspondingly shaped glass block, i.e., whose length and width are substantially the same as those of the pocket. The depth of the pocket (i.e., the height of the rib) should be sufficient to align the glass blocks in the pockets and prevent them from shifting. The width of the rib is determined according to the intended spacing between adjacent blocks.

The size of the template and its overall configuration in terms of the sizes and number of ridges and pockets is determined arithmetically by the dimensions of the glass blocks and the number, arrangement of and spacing between the blocks that are to be used in forming the module. For example, when glass blocks each having nominal dimensions of 8"×8" (width×length) are used to form a module with an intended spacing between blocks of ¼", the size of the template for a 6-block module (2×3 blocks) is 16¼"×24¼" (width×length). (Glass blocks sold commercially are ¼" smaller than their nominal size; thus, a nominal 8"×8" glass block is actually 7¾"×7¾", etc.). When 6"×8" blocks are used with an intended spacing between blocks of ¼", the size of the template for a 9-block module (3×3 blocks) is 18¼"×24¼". When 6"×6" blocks are being used with an intended spacing between blocks of ¼", the size of the template for a 12-block module (3×4 blocks) is 18¼"×24¼". When 4"×8" blocks are used with an intended spacing between blocks of ¼", the size of the template for a 12-block module (2×6 blocks) is 16¼"×24¼".

The template of the invention can be made of any material sufficiently rigid (such as plastic, cardboard, wood, ceramic and metal) to permit the setting-up of glass blocks thereon to form a wall or panel module. To form a flat module (a plurality of which are assembled to form a flat wall or panel), the template is placed and used on a flat, horizontal surface. Desirably, the template is fashioned of a material and thickness so that it has sufficient flexibility so that, if desired, it can be placed on a curved (either convex or concave) surface to form a curved module for use in assembling correspondingly curved walls and panels. Among suitable materials, plastic is preferred because of its low material and fabrication costs and desirable physical and mechanical properties (e.g., stiffness, compressive strength and low weight). Because of the low costs associated with plastic templates, they need be used only once and then discarded. The templates are advantageously shaped (e.g., molded in the case of plastic such as polyethylene or polypropylene) so that the ridges between pockets are tapered or truncated (when viewed in cross-section) to facilitate forming the templates and removing them from the mold, nesting and stacking the templates for shipment and storage (so that there is no wasted space between adjacently stacked templates), aligning glass blocks in the pockets, applying mortar between the glass blocks, and removing the template from the finished module.

The molding template can be provided with means for enabling a plurality of templates to be properly aligned and overlapped in coplanar disposition for situations where it is desired to connect or join them together to form larger templates. One example of such a connecting or joint means is an outward extension of those ribs which extend inward from two adjacent sides as shown in FIG. 1 so as to form connecting tabs. If the tabs are not desired, then they can be snipped off with a cutter. Each tab is configured to mate with the underside of the counterpart ridge of the adjacent template whereby such ridges are registered in perfect alignment. In this way, corresponding ridges on the sides where the templates are to be joined overlap each other to form a common rib. Thus, for example, by connecting four 6-block templates (thereby forming in effect a 24-block template), a 24-block panel module can be formed with great ease and convenience.

Another aspect of the present invention is a method of forming glass block panel modules. The method comprises (1) placing a template of the present invention substantially horizontally on a work table or surface, (2) placing glass blocks within the pockets of the template, (3) grouting the glass blocks by disposing mortar between adjacent blocks, (4) optionally strapping the glass blocks around the periphery of the module for greater security in subsequent shippping, storage and use, and (5) detaching the grouted glass blocks after the grout material has cured. For this purpose, a mortar such as Portland cement grouting is preferred. If desired, a water proofing agent can be applied or waterproof Portland cement can be used. Other suitable mortars will suggest themselves to those skilled in the glass block wall and panel construction art having the benefit of the present disclosure before them.

By virtue of the present invention, glass block panel modules can be obtained in which the blocks are accurately aligned and spaced appropriately (uniformly in cases when the ribs on the template are of equal width) in both the width and height directions so that the edges of the module are straight and square even though the dimensional tolerances of the individual glass blocks admit of some blocks being out of square. A plurality of glass block modules can thus be assembled to construct panels or walls on-site so that the appearance of the wall or panel constructed of such modules is extremely uniform and of consequent pleasing appearance to the eye of even the most fastidious architect, building contractor or customer.

3. BRIEF DESCRIPTION OF THE DRAWING

Referring to the drawing, FIG. 1 is an elevational view in perspective of an embodiment of the molding template of the invention and glass blocks disposed on the template according to the method of the invention.

4. DESCRIPTION OF THE PREFERRED EMBODIMENTS

4.1. Example 1

Referring to FIG. 1, molding template 1 comprises six square pockets 2 and criss-crossing upwardly projecting ribs 3. The ribs 3 are tapered in the sense that the width of the base 11 of the rib is greater than the width of the top surface 9 of the rib. Each glass block 4 is placed in an individual pocket. Standard dimensions of the glass block of width 5, length 6, and height 7 are 8"×8"×3⅞". The width and length of the pocket at its base are equal to the aforesaid corresponding dimensions of the glass blocks. The height 8 of the ribs (and hence the depth of the pocket) is ¼". The width 9 of the top surface of the ribs 3 is ¼"; the width 11 of the base of the ribs is ⅜".

Then, the mortar, e.g., Portland cement grouting, is injected into the spaces 10 between adjacent blocks up to the height of the blocks. An exemplary grouting is made by slurrying with water a mixture of one part by volume Portland cement, ¼ to ½ parts by volume lime, and sand equal to between about 2¼ and 3 times the volume of cement-plus-lime. Temporary sides can be disposed against the periphery of the module being formed so as to prevent the mortar from running out the sides.

When the mortar has cured, the module can be secured with straps (not shown) around its circumference to strengthen the module for shipping. The strapping can be removed from the template prior to use. A 6-block (3×2 blocks) module is thus obtained.

4.2. Example 2

Four templates of the type shown in FIG. 1 are connected and joined (2×2) by tabs 12 on two adjacent sides of each template. Each tab 12 is of a size and shape 15 so that it slides under the upper surface of an inwardly projecting corresponding rib of the adjacent template (not shown). In so doing, the corresponding peripheral ribs of the connected templates are caused to overlap fully and the two templates so joined are placed into and kept in perfect alignment (vis-a-vis the ridges) on the work table or surface. In this way, the same spacing is achieved between glass blocks separated by the overlapped ribs as between adjacent glass blocks on the same template. By the same method as described in Example 1, a 24-block module of 24 (6×4 glass blocks) is obtained.

The foregoing description is intended to illustrate the invention, and it is understood that changes and variations can be made in the foregoing embodiments without departing from the scope of the invention which is defined in the following claims.

I claim:

1. A template for use in forming a glass block panel module, comprising a sheet material having a plurality of sets of criss-crossing tapered upwardly projecting ribs and a plurality of square pockets surrounded by the ribs, whereby glass blocks can be placed within the pockets and grouted by injecting fluid grout material between adjacent blocks to form the module, and wherein the template is further equipped with means for joining a plurality of templates to form a larger, composite template, said joining means comprising a rib with a tab extending outwardly from a side of the template and overlappingly registrable with a rib of an adjacent template to form a rib of equivalent size to the upwardly projecting ribs.

2. A template according to claim 1 wherein the template is made of plastic.

* * * * *